US006205591B1

(12) United States Patent
Wheeler et al.

(10) Patent No.: US 6,205,591 B1
(45) Date of Patent: Mar. 27, 2001

(54) TAILORED GARMENT WITH INTEGRAL SUPPORT UNIT

(75) Inventors: Thomas M. Wheeler, University City; Al Yoffee, St. Louis; Jane Kochmann, St. Louis; Judy France, Lake St. Louis, all of MO (US)

(73) Assignee: Hartmarx Corporation, Chicago, IL (US)

( * ) Notice: Subject to any disclaimer, the term of this patent is extended or adjusted under 35 U.S.C. 154(b) by 0 days.

(21) Appl. No.: 09/455,273

(22) Filed: Dec. 6, 1999

Related U.S. Application Data

(60) Provisional application No. 60/157,292, filed on Oct. 1, 1999.

(51) Int. Cl.[7] ..... A41D 1/06
(52) U.S. Cl. ..... 2/227
(58) Field of Search ..... 2/227, 409; 450/95, 450/126, 156

(56) References Cited

U.S. PATENT DOCUMENTS

| | | | | |
|---|---|---|---|---|
| D. 280,253 | | 8/1985 | Williams . | |
| D. 295,456 | | 5/1988 | Parr . | |
| D. 389,288 | | 1/1998 | Leinoff . | |
| D. 393,243 | | 4/1998 | Ferguson . | |
| 1,006,800 | | 10/1911 | Schumacher . | |
| 1,271,248 | * | 7/1918 | Walcoff | 2/237 |
| 2,112,893 | | 4/1938 | Harwood . | |
| 2,197,584 | * | 4/1940 | Latter | 2/237 |
| 2,481,396 | | 9/1949 | Cohen . | |
| 2,873,738 | | 2/1959 | Stark . | |
| 2,899,962 | | 8/1959 | Entringer et al. . | |
| 3,068,871 | * | 12/1962 | Rapp | 128/519 |
| 3,127,896 | | 4/1964 | Puliafico . | |
| 3,141,457 | | 7/1964 | Davidson . | |
| 3,162,197 | | 12/1964 | Erteszek . | |
| 3,169,530 | | 2/1965 | Grishman . | |
| 3,169,531 | | 2/1965 | Grishman . | |
| 3,174,482 | | 3/1965 | Parrott . | |
| 3,180,336 | | 4/1965 | Bett et al. . | |
| 3,185,158 | | 5/1965 | Gattuso . | |
| 3,192,930 | | 7/1965 | Grishman . | |
| 3,214,770 | | 11/1965 | Smith . | |
| 3,234,947 | | 2/1966 | Bergstein . | |
| 3,333,589 | | 8/1967 | Cohen et al. . | |

(List continued on next page.)

OTHER PUBLICATIONS

Appleseeds catalog, p. 88 offering "Koret Flatter Fit Pants" (date unknown).

Mark, Fore & Strike catalog, page offering "Body Trimmer" pants and shorts (date unknown).

CW Gifts, LLC, advertisement for "Slimmer Shorts" from Parade Magazine (date unknown).

Nordstrom catalog, p. 69 offering "Curvemaker" pants (date unknown).

Product tag from "Body Trimmer" pants (date unknown).

*Primary Examiner*—John J. Calvert
*Assistant Examiner*—Alissa L. Hoey
(74) *Attorney, Agent, or Firm*—McDermott, Will & Emery

(57) ABSTRACT

A garment comprises an outer shell and a support unit integrally secured thereto by an adjustable securement to allow an upper band of the support unit to expand and contract about a wearer of the garment relatively freely of the waistband of the outer shell so as to avoid collapsing it. The outer shell garment may thus be presented as a tailored, smooth finished garment with no indication that the support unit is beneath and the need to use a stretch fabric in the outer shell waistband is thereby alleviated, facilitating the look of a high quality tailored piece of clothing having a smooth, non-gathered waistband. Integration of the support unit into the outer shell also allows a closure and one or more stays of the support unit to be properly aligned or offset from the outer shell as needed to minimize or prevent bulges or lines in the outer shell.

53 Claims, 10 Drawing Sheets

U.S. PATENT DOCUMENTS

| | | | | |
|---|---|---|---|---|
| 3,399,679 | | 9/1968 | Barg . | |
| 3,417,756 | | 12/1968 | Leventhal . | |
| 3,438,061 | * | 4/1969 | Goldberg | 2/237 |
| 3,457,926 | * | 7/1969 | Bacon et al. | 128/519 |
| 3,503,405 | | 3/1970 | Porco . | |
| 4,069,513 | | 1/1978 | Shiller et al. . | |
| 4,106,514 | | 8/1978 | Lowth . | |
| 4,121,305 | | 10/1978 | Kolker . | |
| 4,184,494 | | 1/1980 | King, Jr. . | |
| 4,282,608 | * | 8/1981 | Amberg | 2/227 |
| 4,596,253 | | 6/1986 | Griffith . | |
| 4,671,264 | | 6/1987 | Frangi . | |
| 5,127,108 | | 7/1992 | Weiss . | |
| 5,161,257 | | 11/1992 | Arensdorf et al. . | |
| 5,283,910 | * | 2/1994 | Flint | 2/76 |
| 5,669,072 | | 9/1997 | Bjorklund . | |
| 5,784,723 | | 7/1998 | Noble et al. . | |
| 5,888,118 | | 3/1999 | Kishi . | |

* cited by examiner

*Fig. 7*

| COMPARATIVE MEASUREMENTS OF SHELL GARMENT VS. BODY SHAPER | | | | | | | |
|---|---|---|---|---|---|---|---|
| MISSES GARMENT SIZE | 6 | 8 | 10 | 12 | 14 | 16 | 18 |
| LENGTH OF OUTER SHELL WAISTBAND (IN) | 28 | 29 | 30 | 31 1/2 | 33 | 34 1/2 | 36 1/2 |
| LENGTH OF SUPPORT UNIT UPPER BAND (IN) | 26 | 27 | 28 | 29 1/2 | 31 | 32 1/2 | 34 1/2 |
| OUTER SHELL HIP CIRCUMFERENCE (IN) | 38 1/2 | 39 1/2 | 40 1/2 | 42 | 43 1/2 | 45 | 47 |
| SUPPORT UNIT HIP CIRCUMFERENCE (IN) | 28 1/2 | 29 1/2 | 30 1/2 | 32 | 33 1/2 | 35 | 37 |
| VERTICAL LENGTH OF SUPPORT UNIT (IN) | 8 | 8 | 8 | 8 1/4 | 8 1/2 | 8 7/8 | 9 1/4 |

TAILORED GARMENT WITH INTEGRAL SUPPORT UNIT

This application claims benefit to provisional application No. 60/157,292 filed Oct. 1, 1999.

BACKGROUND OF THE INVENTION

1. Field of the Invention

The present invention relates generally to a garment having a body support unit secured thereto; particularly to a garment having a body support unit secured thereto in a manner allowing the support unit to expand or contract substantially freely of the garment.

2. Background

Support units have long been used for compressing unwanted body bulges to conceal them from view and provide a thinner or smoother body image. One example of a support unit is commonly referred to as a girdle. To complete the desired image, the support unit was often concealed beneath outer clothing to prevent others from detecting that the support unit was employed to provide the thinner, smoother image exhibited. While some garments have been manufactured in the past with interior support or stretch panels fixed thereto, such garments have typically been assembled utilizing exterior shell fabrics of the type that incorporate mechanical stretch properties inclusively engineered into the woven or knitted shell fabric.

One such garment is disclosed by Kishi in U.S. Pat. No. 5,888,118. In Kishi, an interior stretch lining is stitched to an outer stretch-type shell garment at the site of the slide fastener (zipper) of the shell. Other garments have an outer shell garment having an elastic-type gathered waistband employed to allow the marrying of a smaller waistband of a stretch lining to the larger elastic-type gathered waistband of the shell. In these garments, the lining waistband and the shell waistband are each typically constructed to be smaller than the waist of the intended wearer such that upon placing the garment on the wearer's body, both the shell waistband and the stretch lining were stretched and the propensity for the lining to return to its relaxed state allowed the lining to have its intended effect of compressing the wearer's body bulges. With the lining fastened directly to the shell, the contraction of the lining waistband caused a concomitant contraction in the shell waistband. Thus, the elastic gathered waistband was gathered and bunched by the contraction of the stretch lining as it contracted to the wearer's body. In yet another example disclosed by Bergstein in U.S. Pat. No. 3,234,947 a stretch lining having panels of Lycra® was cut to be relaxed at the top of the front and back panels of the outer shell garment. The bottom of the Lycra® panels were cut to be narrower than the accompanying shell leg panels with which they were to be combined. However, the expansion and contraction of the stretch linings of these prior garments resulted in a concomitant reaction at the outer shell garment attached thereto causing an unattractive and cheaper, low-end look to the garment.

SUMMARY OF THE INVENTION

The present invention provides tailored or casual garments such as ladies slacks, shorts, skirts, and dresses, or men's tailored or casual trousers and shorts, having a fully integrated inner support unit. The inner support unit of the present invention is highly effective in supporting and compressing body bulges into a smoother, more flattering appearance while the outer garment simultaneously offers the exterior appearance of a highly tailored article of clothing of the type not previously associated with an integral support unit, and concealing the presence of the inner support unit.

The present invention enables integral incorporation of a support unit into a shell garment of any type of cloth fabrication such as worsted woolens, cotton poplins, linens, poly combinations, as well as knitted goods and any other stretch fabric of natural or artificial makeup or blends thereof, while allowing the support unit to expand or contract about a wearer's body, without affecting the look of the shell garment due to bunching or the like, by buffering the support unit from the shell.

One objective of the present invention is to provide highly desirable tailored or casual garments to individuals who consciously want to employ a support unit therewith to provide an improved lower body appearance.

Another objective of the present invention is to provide an integrated shell garment and support unit wherein the support unit will constrict and flatten the abdomen, smooth the hips, and constrict and shape the buttocks.

A further object of the present invention is to enable a highly expandable and relatively smaller-sized support unit waistband to be integrated with a relatively larger waistband of a tailored shell without pulling in, collapsing or bunching the outer shell or requiring a gathered, elastic-type waistband which connotes a lower-end product.

An additional object of the present invention is to provide an integrated shell garment and support unit wherein the support unit is substantially free to expand or contract with respect to the outer shell.

Another object of the present invention is to provide an integrated shell garment and support unit wherein the support unit is integrated into the outer shell by a buffering adjustable securement which facilitates relatively free expansion and contraction of the support unit with respect to the outer shell.

A further object of the present invention is to provide an integrated shell garment and support unit wherein the support unit is integrated into the outer shell by a buffering adjustable securement which facilitates relatively free expansion and contraction of the support unit waistband with respect to the outer shell waistband.

An additional object of the present invention is to provide an expandable support unit integrated to a substantially non-expandable portion of an outer shell garment wherein the support unit is substantially free to expand or contract with respect to the shell without pulling in, collapsing or bunching the outer shell or requiring a gathered, elastic type waistband which connotes a lower-end product.

Another object of the present invention is to provide a method of constructing an integrated shell garment and support unit wherein the support unit is integrated into the outer shell by a buffering adjustable securement which facilitates relatively free expansion and contraction of the support unit waistband with respect to the outer shell waistband.

Still a further object of the present invention is to provide an integrated shell garment and support unit wherein the support unit is aligned with respect to the shell in order to minimize the visibility of the support unit through the shell.

An additional object of the present invention is to provide an integrated shell garment and support unit wherein the support unit may be quickly disconnected from the shell garment.

Yet another object of the present invention is to provide an integrated shell garment and support unit wherein the support unit is resistant to bunching or riding up the body of the person wearing the garment.

BRIEF DESCRIPTION OF THE DRAWINGS

FIG. 7 comprises a table indicating comparative dimensions of the outer shell and support unit of one embodiment of the garment of the present invention.

DETAILED DESCRIPTION OF THE INVENTION

Figure 1A:
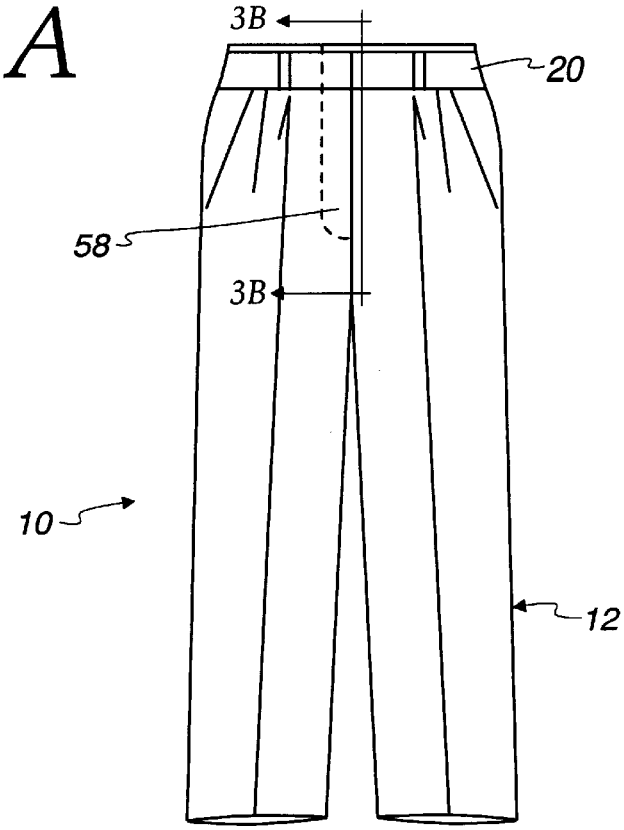
FIG. 1A is a front elevational view of one embodiment of the garment of the present invention.
Figure 1B:
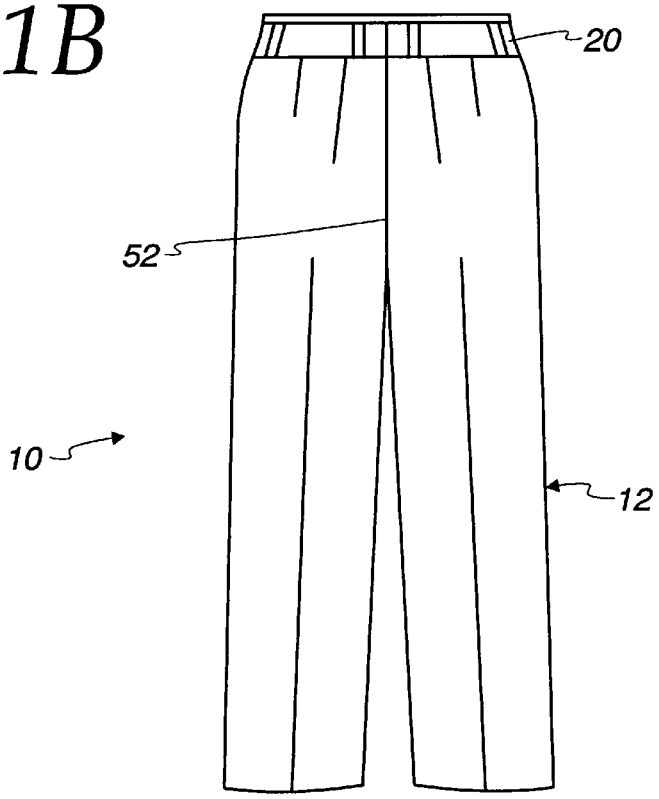
FIG. 1B is a rear elevational view of the garment of FIG. 1A.
Figure 2A:
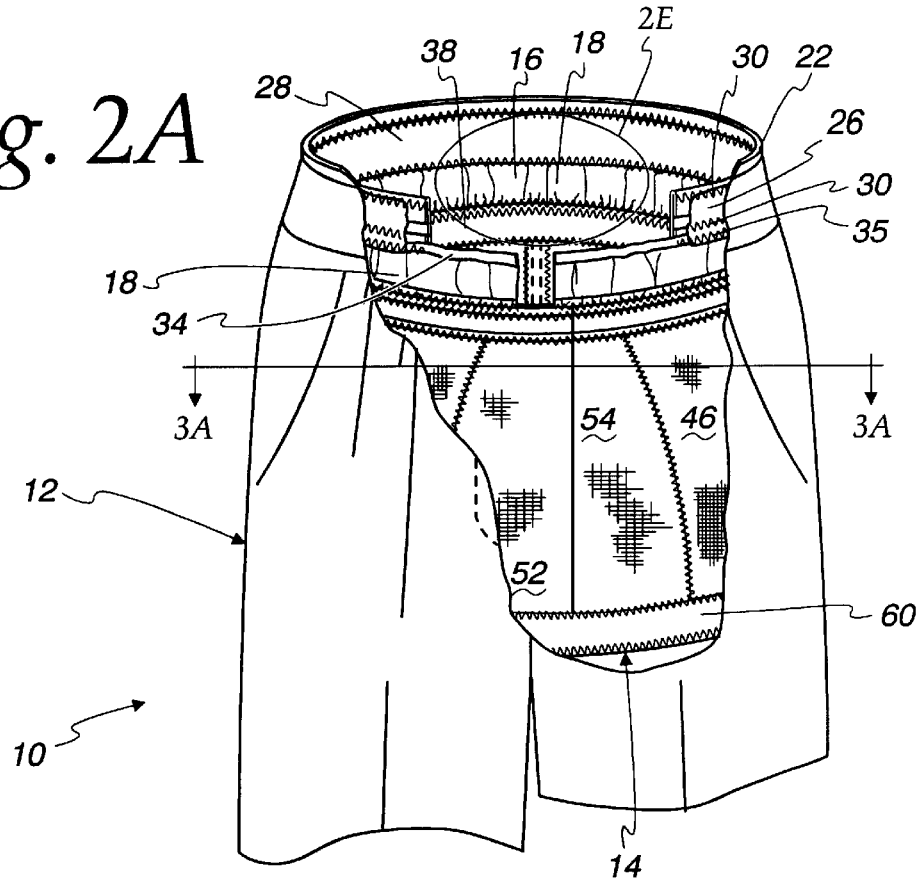
FIG. 2A is a front perspective view of the garment of FIG. 1A with the outer shell garment partially cut away to expose a support unit attached thereto according to the present invention.
Figure 2B:
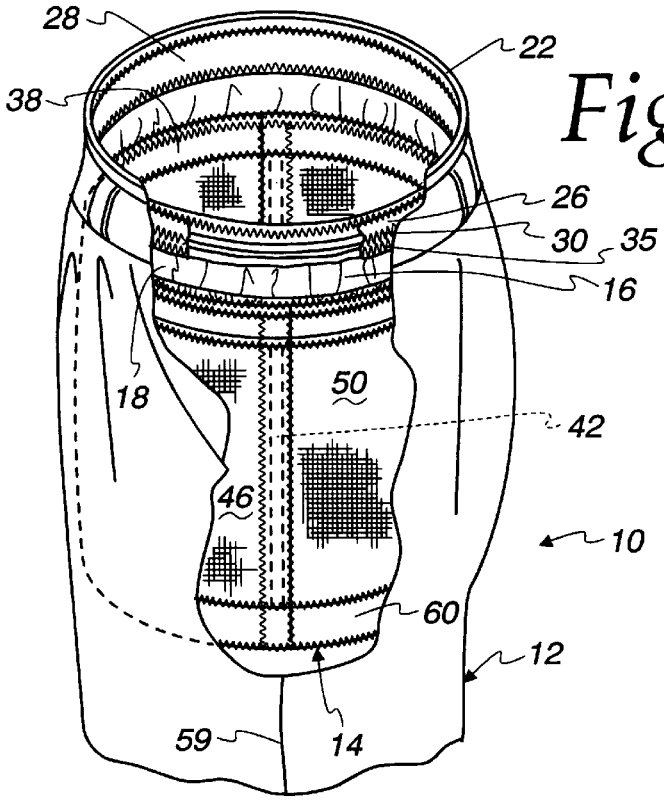
FIG. 2B is a side perspective view of the garment of FIG. 2A with the outer shell garment partially cut away to expose a support unit attached thereto according to the present invention.
Figure 2C:
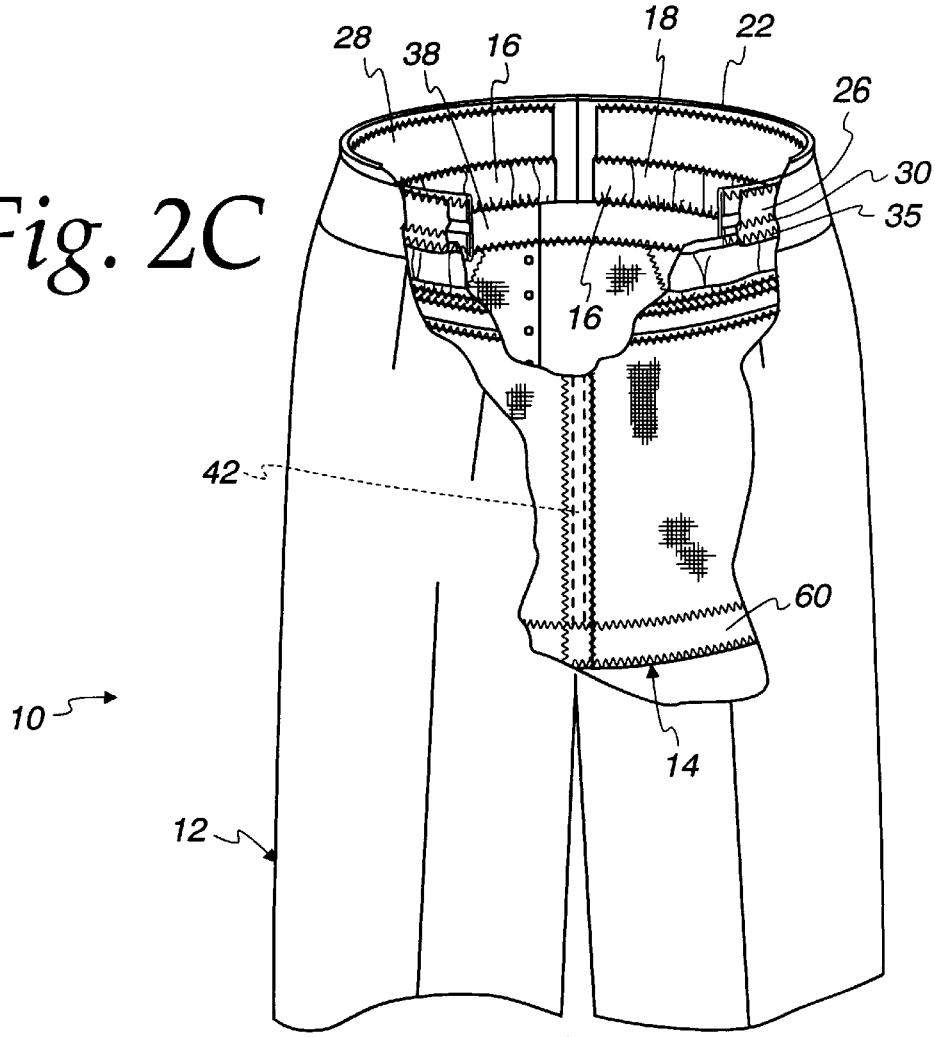
FIG. 2C is a rear perspective view of the garment of FIG. 2A with the outer shell garment partially cut away to expose a support unit attached thereto according to the present invention.
Figure 2D:
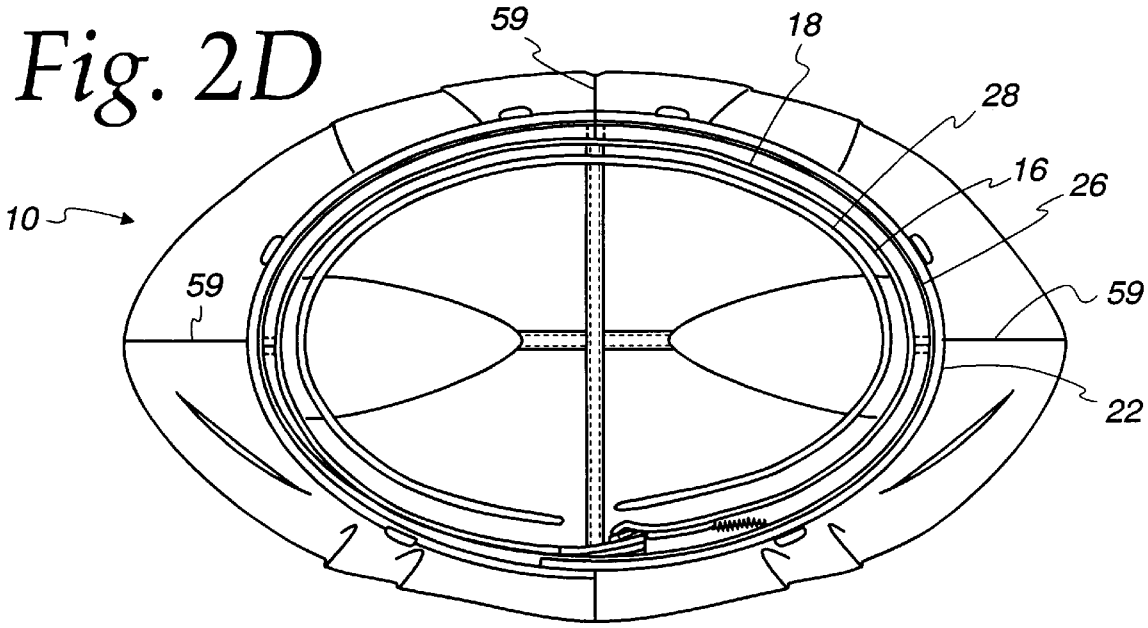
FIG. 2D is an exploded top elevational view of the garment of the FIG. 2A.
Figure 2E:
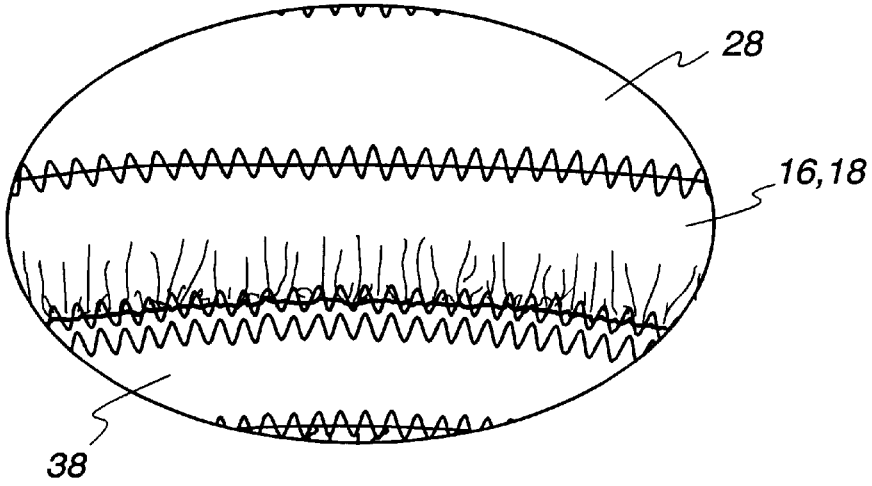
FIG. 2E is an enlarged view of portion 2E of the support unit, the adjustable securement and the outer shell waistband of FIG. 2A.

One embodiment of the garment 10 of the present invention is depicted in FIGS. 1A, 1B which indicate a pair of slacks having a fully integrated inner support unit concealed therein. While the garment 10 is depicted as a pair of slacks, the present invention provides for any tailored or casual garments such as ladies slacks, shorts, skirts, and dresses, or men's tailored or casual trousers and shorts, having a fully integrated inner support unit. One embodiment of the garment 10 of the present invention shown in FIGS. 2A–2E and 3A–3B wherein an outer shell garment 12 is integrally attached to a support unit 14 by an adjustable securement 16. In FIGS. 4A–4B, 2A–2E and 3B the adjustable securement 16 is comprised of an adjuster band 18. As depicted in FIG. 3B, a waistband 20 of the outer shell 12 comprises a waistband shell 22, a banrol 24, a waistband curtain underskirt 26 and a waistband curtain 28, all of which are attached along securing lines 30. These components of the outer shell waistband 20 may be attached along the securing lines 30 by stitching or other methods known in the art. The components of the outer shell waistband 20 described herein constitute only one of many shell waistband constructions capable of use with the present invention. An upper end 34 of the adjuster band 18 is secured to a lower end 32 of the waistband curtain underskirt 26 along securing line 35 by stitching or other methods known in the art. Securement of the adjuster band 18 to the waistband curtain underskirt 26 along securing line 35 may accomplished by any of these known methods in a continuous or intermittently dispersed manner about securing line 35. An adjuster band lower end 36 is secured to a support unit upper band 38 which circumscribes the upper end of the support unit 14 which is, in turn, secured to a support unit body 40 which comprises the various panels described hereinbelow.

Figure 5:
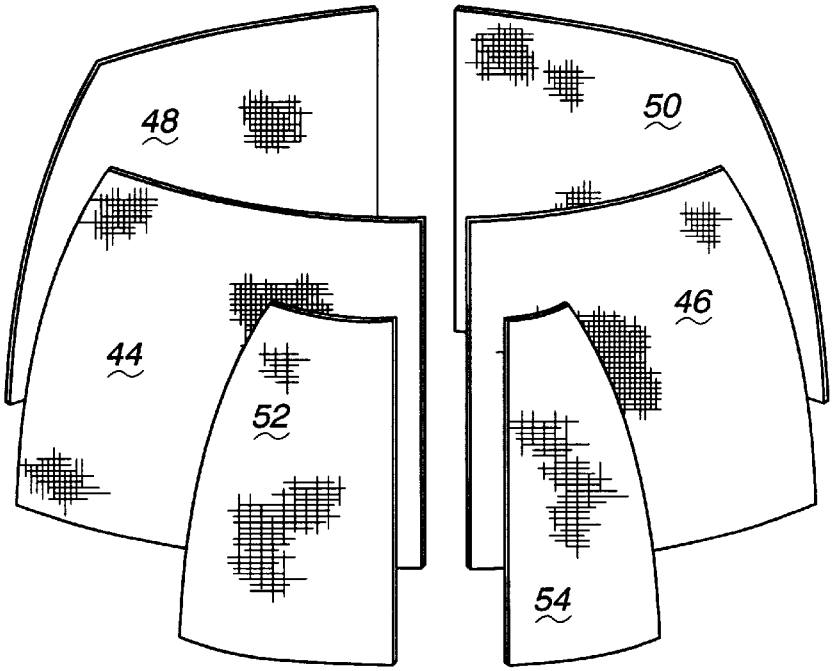
FIG. 5 is an exploded perspective view of the various panels and overlays of the support unit of the present invention.
Figure 6A:
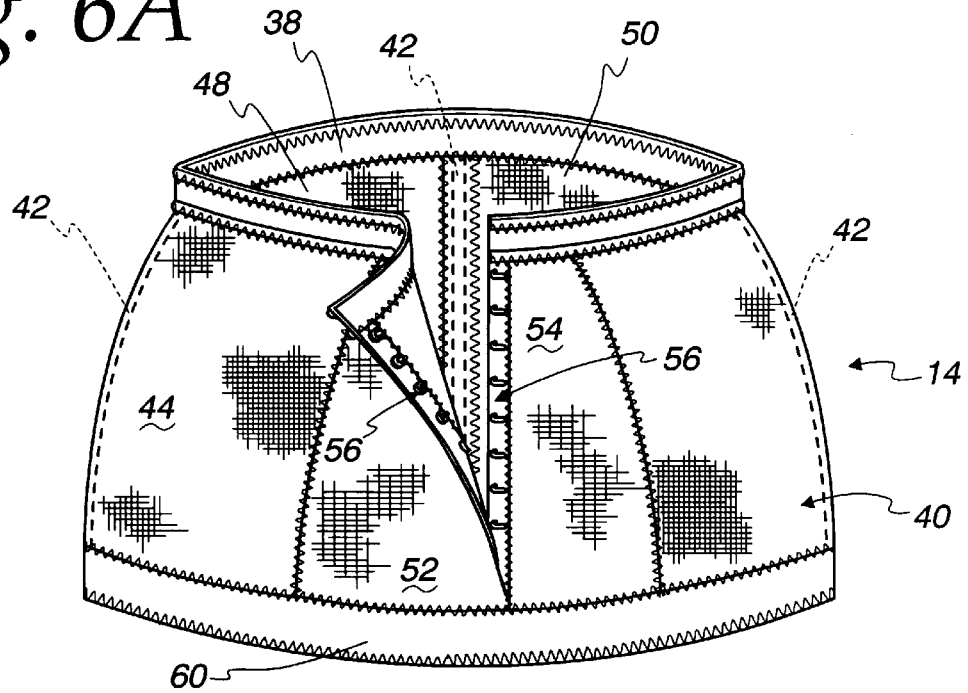
FIG. 6A is a front perspective view of one embodiment of the support unit of the present invention.
Figure 6B:
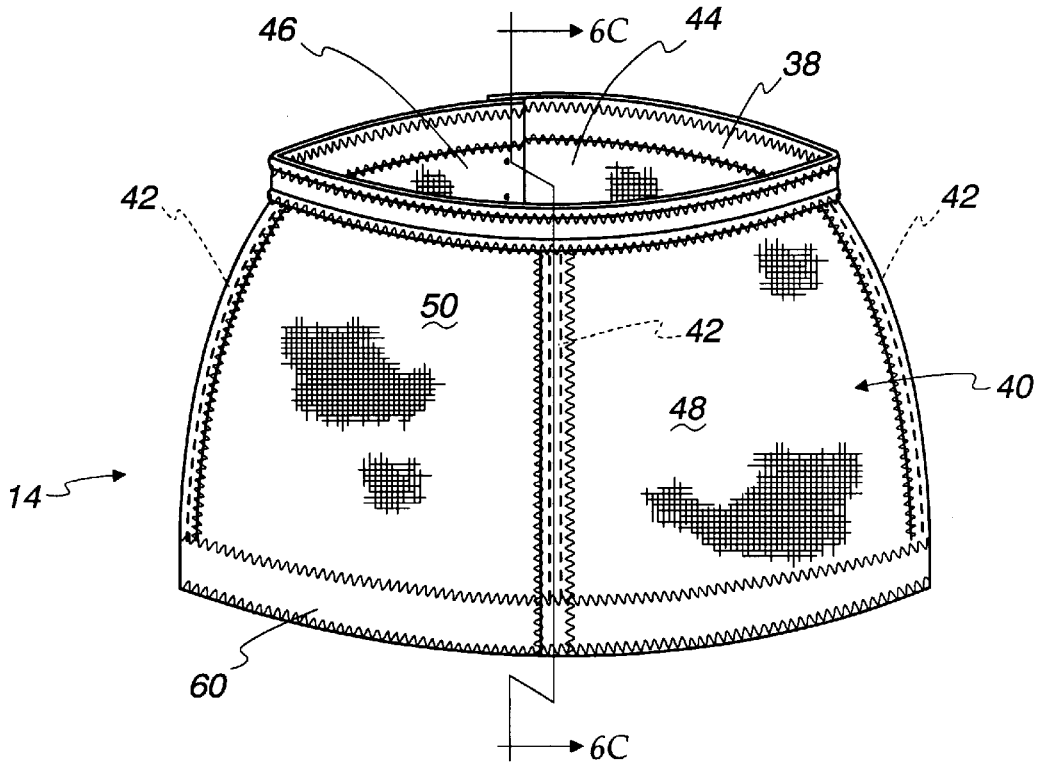
FIG. 6B is a rear perspective view of the support unit of FIG. 6A.
Figure 6C:
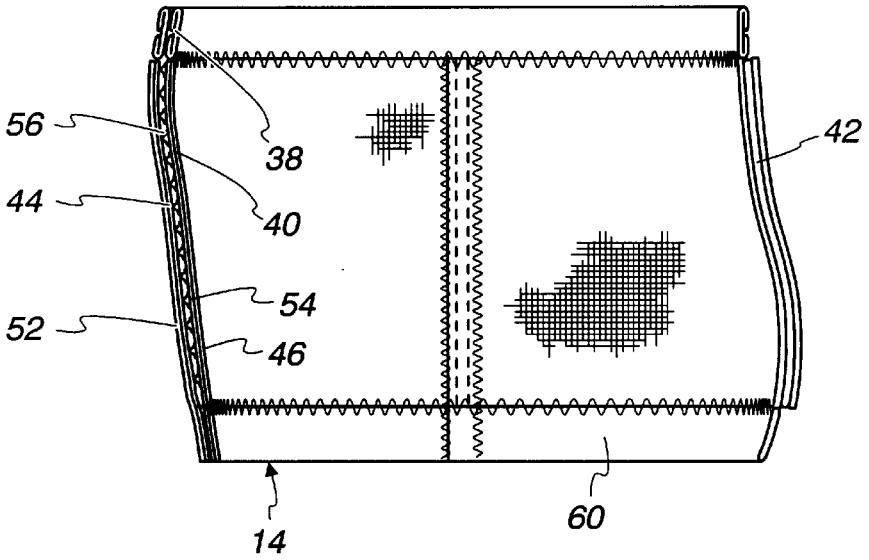
FIG. 6C is a cross-sectional view of the support unit of FIG. 6B taken along line 6C—6C.

As shown in FIGS. 3B and 6B, the support unit body 40 may comprise one or more stays 42 to resist the tendency of the support unit 14 to ride up the body of the wearer causing bunching which may result in visible lines in the outer shell garment 12 or general discomfort to the wearer. One embodiment of the support unit body 40 is depicted in FIGS. 5 and 6A–6C comprising four main sections, specifically, a right front section 44, a left front section 46, a right rear section 48 and a left rear section 50. The four main sections 44, 46, 48, 50, depicted in an exploded view in FIG. 5, are constructed of mechanical stretch fabric manufactured of spandex fiber, or the like, having properties which provide for 360° of stretch and recovery. It has been found that comprising the four main sections 44, 46, 48, 50 of a stretch fabric marketed as Darlington Powernet #5614 provides sufficient stretch and recovery properties to achieve the goals of the present invention. Other fabrics may be substituted consistent with the objectives of the present invention. The support unit body 40 further comprises a pair of overlays, specifically, a right front overlay 52 and a left front overlay 54 positioned on opposing sides of a support unit closure 56 and over the right and left front main sections 44, 46 respectively as depicted. The overlay sections 52, 54 are manufactured of a two-way, vertical only stretch material such that the overlay sections will stretch only in the vertical direction. Thus, the pair of overlays 52, 54 provide additional compression and control at the front of the support unit 14 which will associate with the lower abdomen of a wearer. In one embodiment, the overlays 52, 54 are made of a stretch fabric marketed as Native #42118. Other fabrics may be substituted consistent with the objectives of the present invention. Of course, the strength of the stretch and recovery properties of any of the four main sections 44, 46, 48, 50 or the overlays 52, 54 may be varied to provide more or less support to the wearer of the garment 10. Furthermore, other support garments of varying constructions can be used in practicing the invention.

The main sections 44, 46, 48, 50 of the support unit body 40 are secured together, as depicted, between the right front section 44 and the right rear section 48, between the left front section 46 and the left rear section 50, and between the right rear section 48 and the left rear section 50 by known methods. It has been found that stitching of a zig zag nature, as known in the art, allows the stretching and recovery of the fabrics without breaking the stitching. It has also been found that threads having a polyester core with a cotton wrap cover afford proper stitching. Other stitching and threads may be employed as known in the art to accomplish the objectives of the present invention. The right and left front sections 44, 46 (along with the overlays 52, 54 respectively secured thereto) are selectively secured one to the other by the closure 56 which allows the support unit to be opened for placement over the body of a wearer of the garment 10. While the closure may be of any type known in the art, it has been found that a closure of the hook and eye type (depicted in FIG. 6A) will achieve the objectives of the present invention. Depending on the model and size of the garment 10, it has been found that between five and ten hooks and corresponding eyes will provide a proper closure 56. Using a closure of the hook and eye type allows the stretch fabrics of the support unit 14 to be closed in distinct and disparate segments which allows the closing action to be easier and more comfortable than a continuous closure such as, for example, a zipper. If a zipper were to be employed as the closure of the present invention, then a protective placket should be used to protect the skin of the wearer from being caught therein during zipping. It is contemplated that the closure 56 may allow complete separation of the right and left front sections 44, 46 (along with corresponding overlays 52, 54) as an alternative to only allowing partial separation as depicted in the figures. Additionally, it is contemplated that the support unit 14 may accomplish the objectives of the present invention without any closure, but rather by constructing the support unit as a continuous unit wherein the overlays 52, 54 could be a single overlay and the right and left front sections 44, 46 could be a single front section. In this configuration, the elasticity of the support unit 14 may be adjusted to assure that the support unit 14 may fit over the hips of the wearer.

Regardless of the type of support unit closure employed, it is preferred that the closure is recessed from the outer surface of the support unit 14 to prevent if from protruding into the outer shell 12 and causing a visible bulge. This may be accomplished, for example, by securing the closure to either the inner or outer side of the right and left front sections 44, 46 of the support unit body 40.

Figure 3A:
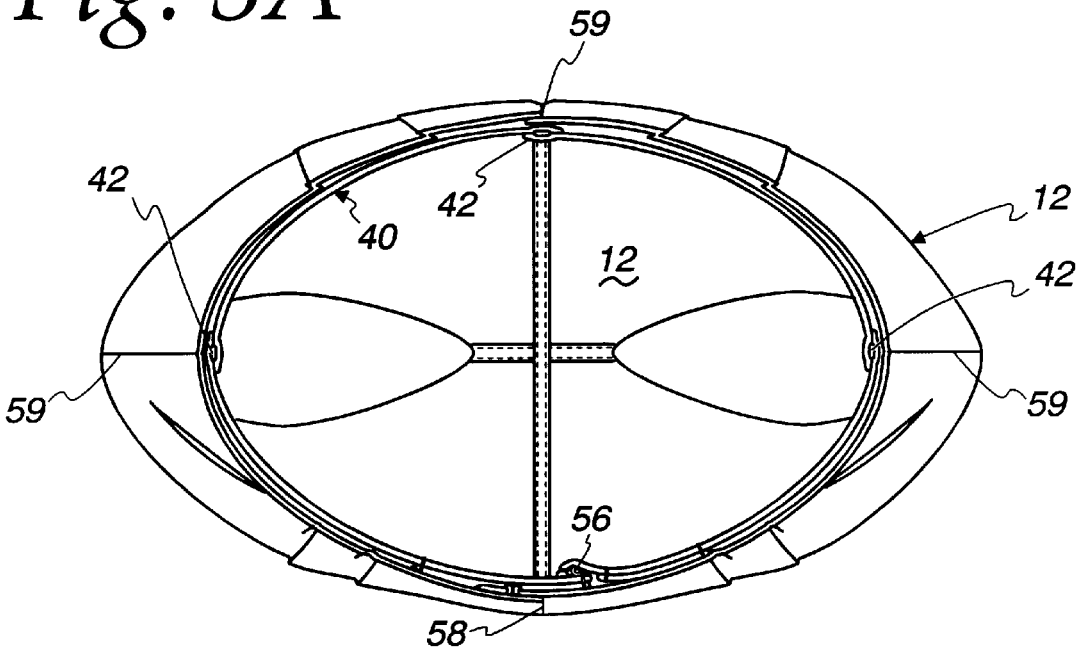
FIG. 3A is a cross-sectional view of the garment of FIG. 2A taken along line 3A—3A.
Figure 3B:
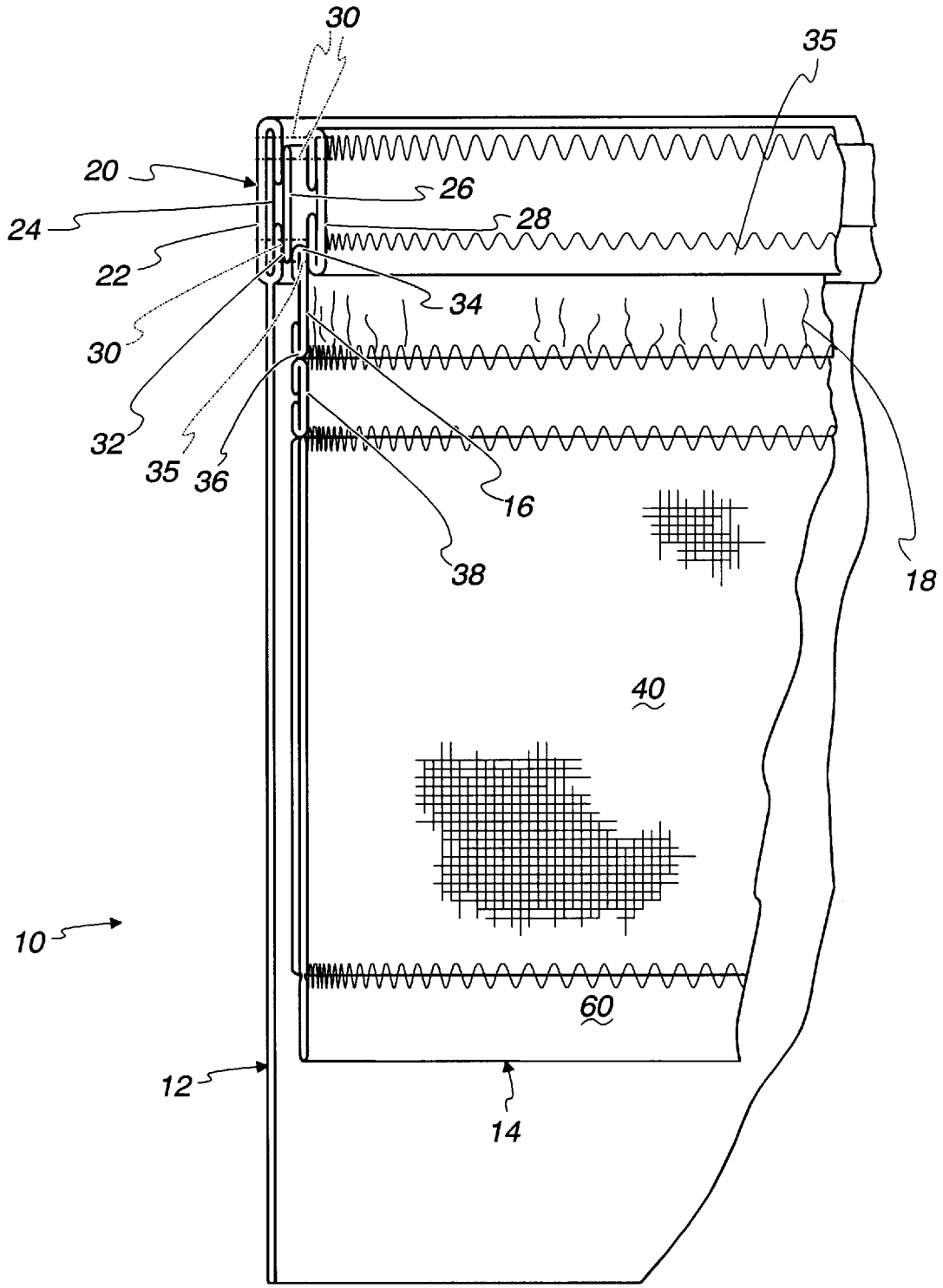
FIG. 3B is a cross-sectional view of the garment of FIG. 1A and a support unit secured therein taken along line 3B—3B.

In one embodiment, the support unit closure 56 is offset from a closure 58 of the outer shell 12 as shown in FIG. 3A. Offsetting the support unit closure 56 in this manner assures that any bulge caused thereby will not be aligned with the outer shell closure 58. Cumulative bulging of the closures 56, 58 is thereby avoided and visible bulging in the front of the outer shell 12 is eliminated or minimized. Offsetting of the support unit closure 56 may be accomplished by configuring the right and left front sections 44, 46 as well as the overlays 52, 54 of the support unit body 40 to be of different sizes or configurations. For example, the right front section 44 and right overlay 52 are depicted herein as larger than the left front section 46 and left overlay 54 to provide the desired closure offset. Other manners of accomplishing this offset are also contemplated. The outer shell closure 58 may comprise any typical manner of closing a high quality garment such as a nylon or metal zipper. Other closure methods including, but not limited to, buttons and buttonhole and/or the use of Velcro® closures are also contemplated.

The support unit 14 depicted comprises a plurality of stays 42. One embodiment, as best depicted in FIG. 6B, comprises three stays 42, one at the intersection of each of the right front section 44 and the right rear section 48, the left front section 46 and the left rear section 50, and the right rear section 48 and the left rear section 50. The stays may be secured to the support unit body 40 or pockets may be created at the location of the stays 42 to allow insertion and removal of the stays 42 for cleaning of the support unit 14. Other known methods of incorporating a stay, or other numbers of stays may also be employed consistent with the objectives of the present invention. Importantly, by placing the stays 42 at these positions in the support unit 14, the stays 42 will be aligned with the seams 59 of the outer shell 12. Aligning the stays 42 with the seams 59 of the outer shell 12 will assist in hiding the presence of the stays which might otherwise become visibly evident at the exterior of the outer shell 12.

It has become evident that integrating the support unit 14 into the outer shell 12 of the garment 10 of the present invention allows the garment 10 to be properly designed to hide the presence of the support unit 14 by "marrying" the construction of the support unit 14 to that of the outer shell 12. As described above, the garment 10 of the present invention has, in the depicted embodiment, offset the support unit closure 56 from the closure 58 of the outer shell 12 ("closure offset") and has aligned the support unit stays 42 to the outer shell seems 59 ("stay-to-seam alignment"). Each of these features contributes to the concealment of the support unit 14. Moreover, the closure offset and the stay-to-seem alignment is substantially maintained by the integral nature of the present garment 10 provided by the adjustable securement 16.

The support unit 14 further comprises a lower band 60 attached to a lower end of the support unit body 40 which may, depending upon the constrictive force therein, assist the stays 42 in resisting the tendency of the support unit 14 to ride up the body of a wearer. Unlike the support unit upper band 38, the support unit lower band 60 may circumscribe the entire lower end of the support unit body 40 in the depicted embodiment. Both the support unit upper and lower bands 38, 60 may be comprised of an elastic material to assist in assuring that the support unit is closely formed to the wearer. On feminine garments, stretch lace may be employed as, or in addition to, the upper and lower bands 38, 60 to provide an aesthetically pleasing finish to the support unit 14.

Proper integration of the support unit 14 into the outer shell 12 is provided by the adjustable securement 16 which is, in one embodiment, represented in the figures by adjuster band 18. The length of the support unit upper band 38 is preferably shorter than the length of the shell waistband 20 to fit the support unit 14 into the outer shell 12. Therefore, the perimeter of the support unit upper band 38 will be smaller than perimeter of the shell waistband 20 creating a size differential therebetween. Because the outer shell waistband 20 is substantially non-flexible, this size differential will fluctuate as the support unit upper band 38 expands and contracts with the size and movement of the body of a wearer of the garment 10. The adjustable securement 16 accommodates this fluctuating size differential. It is contemplated that the advantages of the present invention may also be achieved by integrally attaching a support unit 14 to an outer shell having a substantially expandable or stretch-type waistband, by the adjustable securement 16 of the present invention.

Figure 4A:
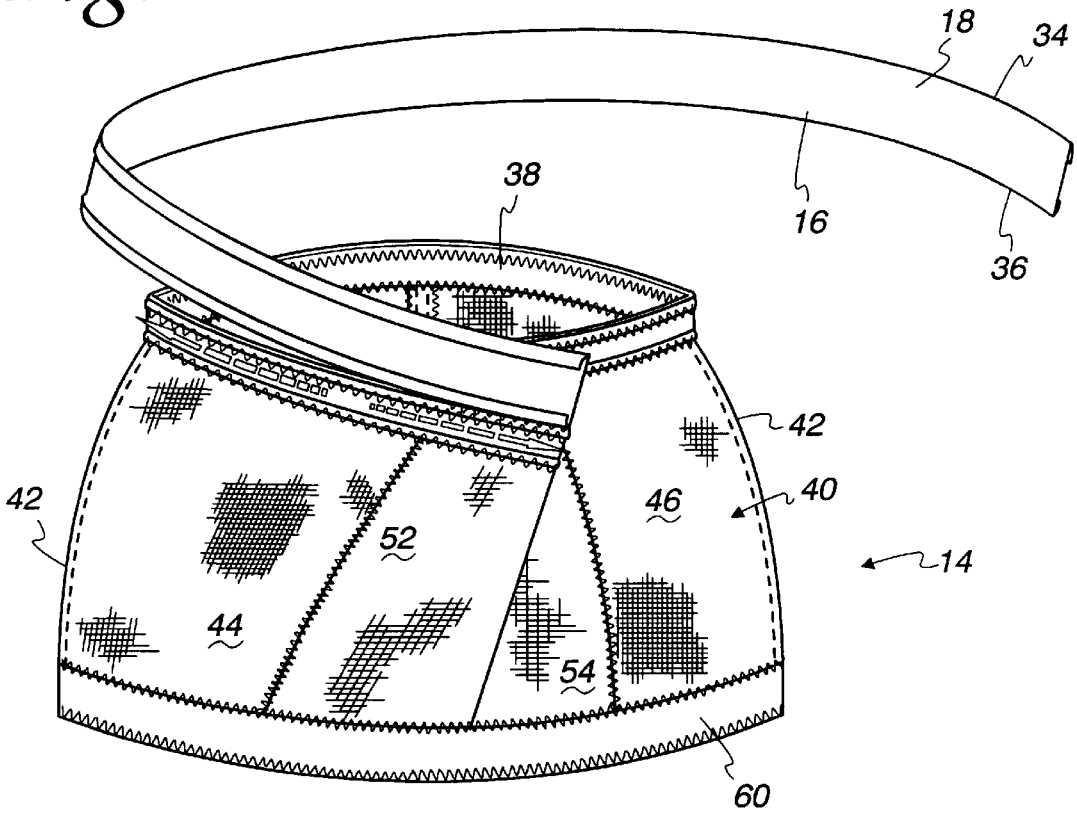
FIG. 4A depicts an adjuster band of the present invention being secured to the support unit of FIG. 6A according to the present invention.
Figure 4B:
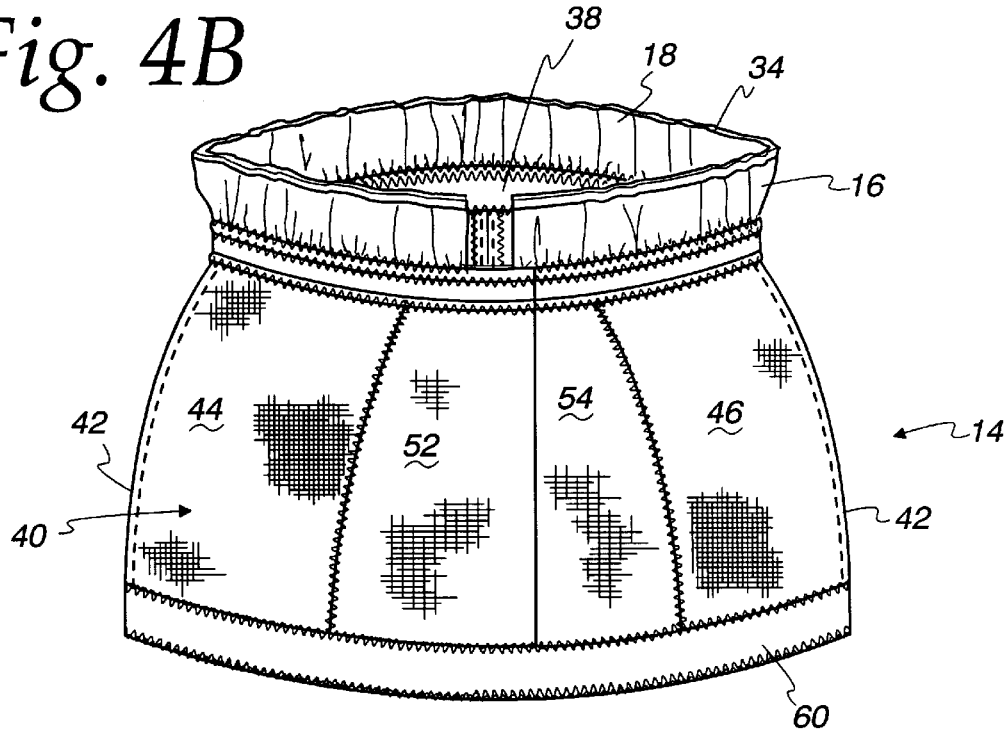
FIG. 4B depicts the support unit of FIG. 6A with the adjuster band fully secured thereto and prior to attachment to the outer shell garment.

In the depicted embodiment, as discussed below with reference to the method of manufacturing the garment 10 of the present invention, the adjuster band 18 is constructed to be substantially the same length as the waistband curtain underskirt 26 to which it is secured. To assure even distribution of the adjuster band 18 about the support unit upper band 38, the two are secured along securing line 35, one to the other, while the support unit upper band 38 is in a stretched configuration wherein the support unit upper band 38 is elongated to substantially the same length as the adjuster band 18. FIG. 4B depicts the adjuster band 18 secured to a support unit upper band 38 with the upper band 38 in a relaxed state and displays the evenly dispersed bunching of the adjuster band 18 which results from the contraction of the support unit upper band 38. Integration is accomplished when the adjuster band upper end 34 is secured to the lower end 32 of the waistband curtain underskirt 26. FIG. 2E provides an enlarged view of the adjuster band 18 accommodating the size differential between the support unit upper band 38 and the smaller outer shell waistband 20. Specifically, it can be seen in FIG. 2E that once attached to the outer shell waistband 20, the adjuster band 18 bunches up only near the lower end 36 thereof while it remains relatively flat near the upper end 34 thereof. Thus, by constructing the adjuster band 18 of a flexible and durable material, it may accommodate the fluctuating size differential between the support unit 14 and the outer shell 12. The flexible and durable adjuster band 18 therefore accommodates this size differential with small bunches which are not detectable through the outer shell 12 and thus contributes to concealing the presence of the support unit 14 unlike prior garments in which the flexible lining was accommodated by being attached to a visible elastic shell waistband. In one embodiment, the adjuster band 18 is made of Darlington #253 nylon spandex. Other fabrics are also contemplated. Proper integration may also comprise employing an adjuster band 18 of a different elasticity than that of the support unit upper band 38. For example, providing the adjuster band 18 with a greater elasticity or expandability than the support unit upper band 38 may assure that the support unit upper band 38 will expand substantially freely of the outer shell waistband 20 such that the expansive and contractive forces of the support unit upper band 38 is not transmitted to the outer shell waistband 20. As discussed below, it is also contemplated that the adjuster band upper end 34 may be attached to the outer shell 12 at other locations such as, for example, the configuration described in reference to the alternative embodiment depicted in FIG. 10.

It has been found that providing a garment 10 with one half inch (0.5 inches) of adjuster band 18 between the securing line 35 and the support unit upper band 38 (i.e. the adjuster band 'height') will allow that garment 10 to meet the objectives of the present invention. Other adjuster band heights are also contemplated as allowing an associated garment to achieve the objectives of the present invention. For example, an adjuster band 18 having a larger height may be desired to allow incorporation of the releasable securement 62 as in the alternative embodiment described below in relation to FIG. 8.

One embodiment of the present invention is comprises various sizes and measurements for the outer shell and the support unit which have been found to meet the objectives of the present invention and can be seen in FIG. 7 for various "Misses" garment sizes of this embodiment. In this embodiment the shell waistband 20 is constructed to be substantially two inches longer than the support unit upper band 38 to provide a wearer with a comfortably fitting outer shell 12 and an effective support unit 14. However, this dimension could vary, depending on construction methods used. While a wearer of the garment 10 of the present invention may vary by body type, it has been found that the hip circumference is one full size larger than the waist circumference on the average person. Therefore, it can be seen in FIG. 7 that for each garment size indicated in this embodiment, the support unit hip circumference (located at lower band 60) is larger than that of the corresponding support unit upper band 38 by two and one half inches. Once again, these measurements can vary, depending on construction methods used. A vertical length of the support unit 14 (measured from the top of the support unit upper band 38 to the bottom of the support unit lower band 60) of eight inches for sizes 6, 8 and 10 in the "Misses" range has been found to meet the objectives of the present invention. On each upwardly graded size thereafter, through size 14, the support unit may be lengthened by ¼ inch. From size 16 and up, the support unit may be increased by ⅜ inch. FIG. 7 depicts the vertical length of the support unit for various "Misses" garment sizes of this embodiment. While the dimensions of FIG. 1 have been found to provide the embodiment of garment 10 employing those dimensions with the advantages of the present invention, other dimensions are contemplated and the present invention is not limited by the dimensions of FIG. 1.

For the embodiments of the present invention described herein, it will become apparent from the description herein that construction of the outer shell 12 is accomplished as with any other outer shell in manners known in the art. In these embodiments, the only requirement for accomplishing the present invention is that the lower end 32 of the waistband curtain underskirt 26 extend below the waistband securing lines 30 to allow securement of the adjuster band 18 thereto. Because this is a standard construction in the garment industry, the outer shell 12 need not comprise any special construction to be susceptible of the present invention. Indeed, any shell of standard construction will allow the present invention to be accomplished by integrating the support unit 14 and adjuster band 18 therein.

In one embodiment, construction of the garment 10 of the present invention is accomplished by constructing the support unit 14 and the outer shell 12 separately. Beneficially, separate construction of the outer shell 12 and the support unit 14 allows for integration of the support unit 14 into any outer shell 12 such that any standard, preconstructed outer shell garment 12 may be susceptible to the benefits of the present invention. Once an appropriately sized support unit 14 is selected for an intended outer shell 12, the adjuster band 18 is constructed to be of substantially equal length to the outer shell waistband 20. The lower end 36 of the support unit upper band 38 is then stretched to the length of the outer shell waistband 20 (and therefore the length of the adjuster band 18) and secured thereto as described herein and depicted in FIG. 4A. Once secured to the support unit (FIG. 4B), the adjuster band upper end 34 is then positioned against the outer shell waistband curtain underskirt 26 in a configuration affording the closure offset and the stay-to-seem alignment discussed above. The upper end 34 of the adjuster band 18 is then secured to the outer shell waistband curtain underskirt 26 along securing line 35 to complete the integration. Both the support unit upper band 38 and the adjuster band 18 may be stretched to the length of the outer shell waistband curtain underskirt 26 during this final step of integration. Alternatively, the support unit upper band 38 may be relaxed and the adjuster band 18 may be stretched to the length of the outer shell waistband curtain underskirt 26.

Alternatively, the adjuster band 18 (with or without the support unit 12 attached) could be secured into the outer shell waistband 20 during construction of the outer shell garment 12 either along waistband securing lines 30 or along the separate securing line 35. However, this alternative method reduces the ease with which the support unit 12 and adjuster band 18 of the present invention may be integrated into a preconstructed outer shell.

Figure 8:
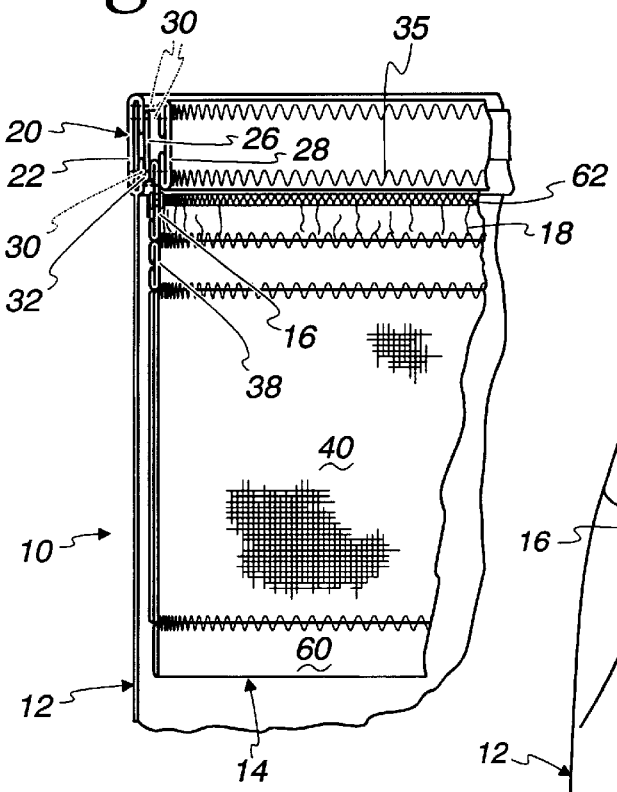
FIG. 8 is a cross-sectional view of an alternative embodiment of the present invention having a detachable support unit.

In another embodiment of garment 10 depicted in FIG. 8, an adjustable securement 16 similar to the adjuster band 18 described above and shown in FIG. 3B, but additionally having a releasable securement 62 along the entire length thereof to allow the support unit 14 to be readily removed from the outer shell 12. In the embodiment depicted in FIG. 8, the releasable securement 62 comprises a fine zipper within the adjuster band 18 allowing the support unit 14 to be zipped out of the outer shell 12. This zip-out embodiment could be appropriate to allow for easier pressing of the shell as well as separate laundering or dry-cleaning of the outer shell 12 and the support unit 14. The zipper embodiment of the releasable securement 62 is not intended to be exclusive and the releasable securement 62 may be comprised of other than a zipper. Alternatively, the adjustable securement 16 could be detachable from the support unit upper band 38 or the outer shell waistband curtain underskirt 26.

Figure 9:
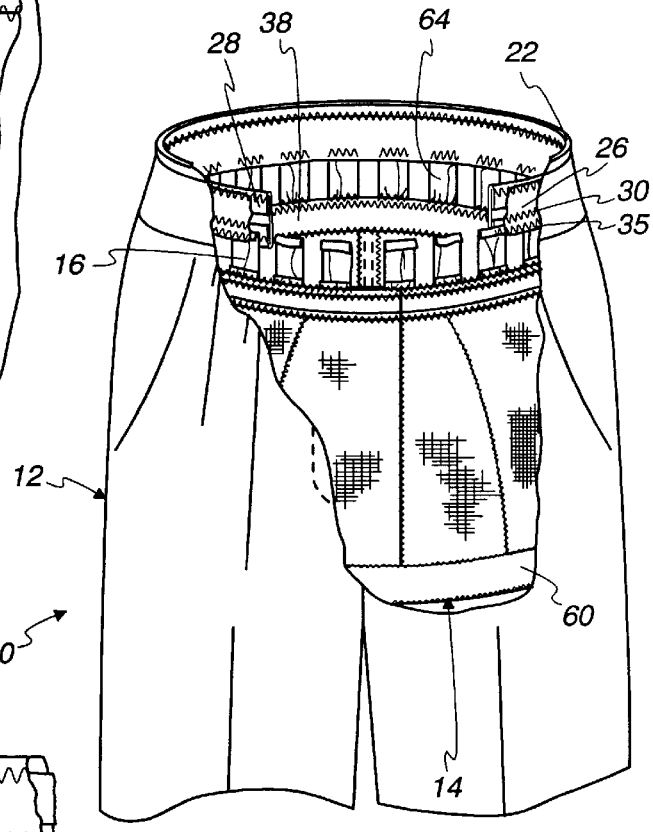
FIG. 9 is a front perspective view of another alternative embodiment of the present invention having an alternative adjustable securement, with the outer shell garment partially cut away.

In another embodiment of garment 10 depicted in FIG. 9, the adjustable securement 16 is comprised of a plurality of distinct and disparate connector tabs 64 (rather than the continuous band of the adjuster band 18) connecting the support unit 14 to the waistband curtain underskirt 26.

Figure 10:
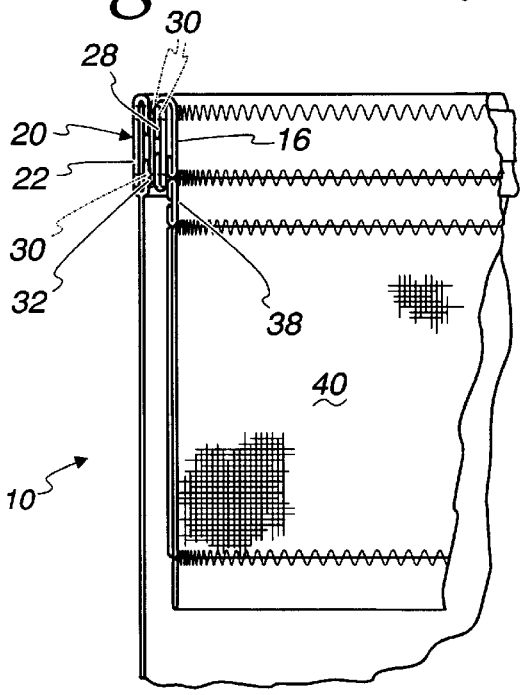
FIG. 10 is a cross-sectional view of another alternative embodiment of the present invention having an alternative adjustable securement.

In yet another embodiment depicted in FIG. 10, the adjuster strip upper end 34 is connected to an upper end of the outer shell waistband curtain underskirt 26 rather than the outer shell waistband curtain underskirt lower end 32 as depicted in FIG. 3B. It is also contemplated that the adjuster strip upper end 34 may be secured to other portions of the outer shell waistband 20 to accomplish the objectives of the present invention.

By securing the support unit 14 to the outer shell 12 via the adjustable securement 16 of the present invention, the garment 10 allows the support unit upper band 38 to expand and contract about the wearer thereof without collapsing the outer shell waistband 20 because the adjustable securement 16 adjusts to both the length of the support unit upper band 38 and the outer shell garment waistband 20. The outer shell garment 12 may thus be presented as a tailored, smooth finished garment with no indication that the support unit 14 is beneath. The need to use a stretch fabric in the outer shell 12 is thereby alleviated and the look of a high quality tailored piece of clothing may be presented having a smooth, non-gathered waistband 20. Integration of the support unit 14 into the outer shell 12 allows the closure and the stays thereof to be properly aligned or offset as needed to avoid creating bulges or lines therefrom.

From the foregoing description, it will be apparent that the garment of the present invention has a number of advantages, some of which have been described above and others of which are inherent in the present invention. Also, it will be understood that modifications can be made to the garment of the present invention without departing from the teachings of the invention. Accordingly the scope of the invention is only to be limited as necessitated by the accompanying claims.

We claim:

1. A garment comprising:

an outer shell having a waistband;

a support unit having mechanical stretch properties for providing a wearer of the garment with bodily support, the support unit defining all upper band; and an adjustable securement attached to the outer shell waistband and the upper band of the support unit the adjustable securement having mechanical stretch properties facilitating substantially independent expansion and contraction of the support unit relative to the outer shell waistband.

2. The garment of claim 1 wherein the adjustable securement secures the upper band of the support unit to the outer shell waistband, the outer shell waistband being substantially non-elastic.

3. The garment of claim 1 wherein the adjustable securement comprises an adjuster band securing the support unit to a waistband of the outer shell.

4. The garment of claim 3, the adjuster band further comprising a releasable securement facilitating selective detachment of the support unit from the outer shell.

5. The garment of claim 4, wherein the releasable securement comprises a zipper.

6. The garment of claim 3 wherein the elasticity of the adjuster band differs from the elasticity of the support unit upper band.

7. The garment of claim 1 further defined in that:

the outer shell comprises a closure and a seem; and the support unit comprises a closure and a stay;

wherein the support unit closure is offset from the outer shell closure and the support unit stay is aligned with the outer shell seem.

8. The garment of claim 1 wherein the support unit comprises a support unit body which is constructed to allow stretching thereof in any direction except for a portion of the support unit body configured to associate with the abdomen of a wearer and is constructed to allow stretching thereof only in the vertical directions.

9. The garment of claim 1 wherein the outer shell is comprised of one of the group consisting of shorts, slacks, trousers, a skirt and a dress.

10. A support unit for integration with a waistband of an outer shell garment, the support unit having mechanical stretch properties to provide bodily support to a wearer of the support unit and the support unit defining an upper band, the support unit having an adjustable securement attached to the upper band for integrating the support unit to the outer shell waistband, wherein the adjustable securement comprises mechanical stretch properties to allow substantially independent expansion and contraction of the support unit relative to the outer shell waistband.

11. The support unit of claim 10, the adjustable securement comprising:

a lower end attached to the upper band of the support unit; and an upper end for attachment to the waistband of the outer shell, the outer shell waistband being substantially non-elastic.

12. The support unit of claim 10 wherein the adjustable securement comprises an adjuster band.

13. The support unit of claim 12, the adjuster band further comprising a releasable securement for facilitating selective detachment of the support unit from the outer shell.

14. The support unit of claim 13, wherein the releasable securement comprises a zipper.

15. The support unit of claim 12 wherein the adjuster band is secured to the upper band of the support unit and the elasticity of the adjuster band differs from the elasticity of the support unit upper band.

16. The support unit of claim 10, the support unit comprising:

a closure configured for being offset from a closure of the outer shell; and a stay configured for being aligned with a seem of the outer shell.

17. The support unit of claim 10 wherein the support unit comprises a support unit body which is constructed to allow stretching thereof in any direction except for a portion of the support unit body configured to associate with the abdomen of a wearer to allow stretching thereof only in the vertical directions.

18. The support unit of claim 10 for attachment to one of the group consisting of shorts, slacks, trousers, a skirt and a dress.

19. A method of constructing a garment comprising the steps of:

a. providing a support unit having mechanical stretch properties to provide bodily support to a wearer thereof, the support unit defining an upper band;

b. providing an adjustable securement for integrating the support unit upper band to a waistband of an outer shell, wherein the adjustable securement has mechanical stretch properties to allow substantially independent expansion and contraction of the support unit relative to the outer shell; and c. securing the adjustable securement to the support unit upper band.

20. The method of claim 19 wherein the step of providing an adjustable securement comprises constructing the adjustable securement to be substantially the same length as a waistband of the outer shell.

21. The method of claim 20 wherein the support unit comprises a support unit body secured to the upper band of the support unit, the step of securing the adjustable securement to the support unit comprises configuring the support unit upper band to be of substantially equal length to the adjustable securement throughout the step of securing the adjustable securement to the support unit.

22. The method of claim 21 further comprising the steps of:

d. providing an outer shell; and e. securing the adjustable securement to the outer shell.

23. The method of claim 22 wherein the step of securing the adjustable securement to the outer shell comprises maintaining the support unit upper band stretched to be of substantially equal length to the outer shell waistband throughout the step of securing the adjustable securement to the outer shell.

24. The method of claim 22 wherein the step of securing the adjustable securement to the outer shell comprises configuring an upper end of the adjustable securement to be of substantially equal length to the outer shell waistband throughout the step of securing the adjustable securement to the outer shell.

25. The method of claim 20 wherein the adjustable securement comprises a releasable securement comprised of a zipper attaching an adjustable securement first part and an adjustable securement second part, the step of securing the adjustable securement to the outer shell comprising securing the adjustable securement first part to the outer shell.

26. The method of claim 20 wherein the step of securing the adjustable securement to the support unit comprises aligning a stay of the support unit with a seem of the outer shell and offsetting a closure of the support unit with a closure of the outer shell.

27. A garment comprising:

an outer shell comprising a closure and a seam and a support unit for providing bodily support to a wearer of the garment integrally secured to the outer shell, the support unit defining a perimeter and comprising a closure and a stay being separated by at least forty-five degrees about the perimeter of the support unit;

wherein the support unit closure is offset from the outer shell closure and the support unit stay is aligned with the outer shell seam.

28. A garment comprising:

an outer shell having a waistband;

a support unit having mechanical stretch properties for providing a wearer of the garment with bodily support, the support unit defining an upper end; and an adjustable securement attached to the outer shell waistband and the support unit adjacent to the upper end thereof, the adjustable securement having mechanical stretch properties facilitating substantially independent expansion and contraction of the support unit relative to the outer shell waistband.

29. The garment of claim 28 wherein the adjustable securement secures the support unit upper end to the outer shell waistband, the outer shell waistband being substantially non-elastic.

30. The garment of claim 28 wherein the adjustable securement comprises an adjuster band securing the support unit to a waistband of the outer shell.

31. The garment of claim 30, the adjuster band further comprising a releasable securement facilitating selective detachment of the support unit from the outer shell.

32. The garment of claim 31, wherein the releasable securement comprises a zipper.

33. The garment of claim 30 wherein the elasticity of the adjuster band differs from the elasticity of the support unit upper end.

34. The garment of claim 28 further defined in that:

the outer shell comprises a closure and a seam; and the support unit comprises a closure and a stay;

wherein the support unit closure is offset from the outer shell closure and the support unit stay is aligned with the outer shell seam.

35. The garment of claim 28 wherein the support unit comprises a support unit body which is constructed to allow stretching thereof in any direction except for a portion of the support unit body configured to associate with the abdomen of a wearer which is constructed to allow stretching thereof only in the vertical directions.

36. The garment of claim 28 wherein the outer shell is comprised of one of the group consisting of shorts, slacks, trousers, a skirt and a dress.

37. A support unit for integration with a waistband of an outer shell garment, the support unit having mechanical stretch properties to provide bodily support to a wearer of the support unit and the support unit defining an upper end, the support unit having an adjustable securement attached adjacent to the upper end thereof for integrating the support unit to the outer shell waistband, wherein the adjustable securement comprises mechanical stretch properties to allow substantially independent expansion and contraction of the support unit relative to the outer shell waistband.

38. The support unit of claim 37, the adjustable securement comprising:

a lower end attached adjacent to the upper end of the support unit; and an upper end for attachment to the waistband of the outer shell, the outer shell waistband being substantially non-elastic.

39. The support unit of claim 37 wherein the adjustable securement comprises an adjuster band.

40. The support unit of claim 39, the adjuster band further comprising a releasable securement for facilitating selective detachment of the support unit from the outer shell.

41. The support unit of claim 40, wherein the releasable securement comprises a zipper.

42. The support unit of claim 39 wherein the adjuster band is secured adjacent to the upper end of the support unit and the elasticity of the adjuster band differs from the elasticity of the support unit upper end.

43. The support unit of claim 37, the support unit comprising:

a closure configured for being offset from a closure of the outer shell; and a stay configured for being aligned with a seem of the outer shell.

44. The support unit of claim 37 wherein the support unit comprises a support unit body which is constructed to allow stretching thereof in any direction except for a portion of the support unit body configured to associate with the abdomen of a wearer to allow stretching thereof only in the vertical directions.

45. The support unit of claim 37 for attachment to one of the group consisting of shorts, slacks, trousers, a skirt and a dress.

46. A method of constructing a garment comprising the steps of:

a. providing a support unit having mechanical stretch properties to provide bodily support to a wearer thereof, the support unit defining an upper end;

b. providing an adjustable securement for attaching the support unit upper end to a waistband of an outer shell, wherein the adjustable securement has mechanical stretch properties to allow substantially independent expansion and contraction of the support unit relative to the outer shell; and c. securing the adjustable securement adjacent to the support unit upper end.

47. The method of claim 46 wherein the step of providing an adjustable securement comprises constructing the adjustable securement to be substantially the same length as a waistband of the outer shell.

48. The method of claim 47 wherein the support unit comprises a support unit body integral with the upper end of the support unit body, the step of securing the adjustable securement to the support unit comprises maintaining the support unit upper end to be of substantially equal length to the adjustable securement throughout the step of securing the adjustable securement to the support unit.

49. The method of claim 48 further comprising the steps of:

d. providing an outer shell; and e. securing the adjustable securement to the outer shell.

50. The method of claim 49 wherein the step of securing the adjustable securement to the outer shell comprises maintaining the support unit upper end stretched to be of substantially equal length to the outer shell waistband throughout the step of securing the adjustable securement to the outer shell.

51. The method of claim 49 wherein the step of securing the adjustable securement to the outer shell comprises maintaining an upper end of the adjustable securement to be of substantially equal length to the outer shell waistband throughout the step of securing the adjustable securement to the outer shell.

52. The method of claim 47 wherein the adjustable securement comprises a releasable securement comprised of a zipper attaching an adjustable securement first part and an adjustable securement second part, the step of securing the adjustable securement to the outer shell comprising securing the adjustable securement first part to the outer shell.

53. The method of claim 47 wherein the step of securing the adjustable securement to the support unit comprises aligning a stay of the support unit with a seem of the outer shell and offsetting a closure of the support unit with a closure of the outer shell.

* * * * *